US005924737A

United States Patent [19]

Schrupp

[11] Patent Number: 5,924,737

[45] Date of Patent: Jul. 20, 1999

[54] POSTCARD CHECK

[75] Inventor: Raymond Edward Frank Schrupp, Waconia, Minn.

[73] Assignee: Young America Corporation, Young America, Minn.

[21] Appl. No.: 08/766,162

[22] Filed: Dec. 12, 1996

[51] Int. Cl.[6] ..... B42D 15/08; B42D 15/10

[52] U.S. Cl. ..... 283/58; 283/116; 283/57; 229/70; 229/92.1; 229/92.8

[58] Field of Search ..... 283/116, 58; 229/70, 229/92.1, 92.8

[56] References Cited

U.S. PATENT DOCUMENTS

| | | | |
|---|---|---|---|
| D. 125,147 | 2/1941 | Bernhardt . | |
| 403,499 | 5/1889 | Williamson . | |
| 508,601 | 11/1893 | Curley . | |
| 914,460 | 3/1909 | Selden . | |
| 1,264,795 | 4/1918 | Hill . | |
| 1,946,751 | 2/1934 | McCarthy . | |
| 3,126,211 | 3/1964 | Hieken et al. . | |
| 4,227,720 | 10/1980 | Mowry, Jr. et al. | 283/58 |
| 5,085,470 | 2/1992 | Peach et al. . | |
| 5,178,418 | 1/1993 | Merry et al. | 283/901 |
| 5,566,981 | 10/1996 | Alcordo | 229/92.8 |
| 5,636,874 | 6/1997 | Singer | 283/58 |
| 5,667,134 | 9/1997 | Olsen et al. | 283/58 |
| 5,695,220 | 12/1997 | Phillips | 283/58 |

OTHER PUBLICATIONS

Postcard check—Fulfillment Systems Inc. (Gillette Custom-plus Refund offer).

Postcard check—Proctor & Gamble (Cheer Refund Offer).

Postcard check—PFC (Revlon Refund Offer).

Postcard check—PFC (Walgreesn Refund Offer).

Postcard check—Gage Marketing Group (Kraft Foods Refund Offer).

*Primary Examiner*—Willmon Fridie, Jr.
*Assistant Examiner*—Mark T. Henderson
*Attorney, Agent, or Firm*—Dorsey & Whitney LLP

[57] ABSTRACT

The present invention discloses a postcard check which can be automatically processed by the U.S. Postal Service and a check clearinghouse. The postcard check meets all the dimensional requirements set forth by the U.S. Postal Service to be classified as a postcard. Moreover, on one side of the postcard check, a postal bar code is placed and positioned such that the postal bar code permits the U.S. Postal Service to automatically process the postcard check through the U.S. mail system. Furthermore, on the other side of the postcard check, a MICR number is placed to allow the check to be processed automatically at a clearinghouse and the banks. Since the postal bar code and the MICR number are on opposite sides of the postcard check, the MICR number is not mutilated by the U.S. Postal Service when it automatically processes the check.

19 Claims, 10 Drawing Sheets

12 10

THE FACE OF THIS DOCUMENT HAS A COLORED BACKGROUND ON WHITE PAPER

MARS

18 FIRST STATE BANK
LAKE LILLIAM, MN 56253
75-1131/919

20 00012345

23 NOT GOOD FOR MORE THAN 0.00

9999-9999 999 9999 YAC INFO XXXXX 21
XXXXINTERNAL NUMBERXXXX

31 XXXXXXOFFER NAMEXXXXXXX
XXXXXXOFFER NAME2XXXXXX

27 **0.00**

PAY 000 & 26 NO/100

25 VOID IF NOT CASHED BEFORE 00/00/00

PAY TO THE ORDER OF: JOHN Q. PUBLIC 24

30 Jay Eckland

22 {:091911315}: 100 465 8"*

THE BACK OF THIS DOCUMENT CONTAINS AN ARTIFICIAL WATERMARK.HOLD AT ANGLE TO VIEW

P.O. BOX 200 32
YOUNG AMERICA, MN 55553-0200

34 FIRST CLASS
U.S. POSTAGE
PAID
Y.A.C.
FULFILLMENT

40 ENDORSEMENT REQUIRED

38

36 JOHN Q. PUBLIC
APT 123
717 FAXON RD
YOUNG AMERICA, MN 55368-0200

14

Fig. 1

Fig. 7

106

P.O. BOX 132
YOUNG AMERICA

110

FIRST CLASS
ZIP & BARCODED
U.S. POSTAGE
PAID
Y.A.C.
FULFILLMENT

134

116

GROLIER INTERACTIVE INC.

SDG

114

FOLD AND TEAR ON PERFORATION

FOLD AND TEAR ON PERFORATION

BETTY GENKE
136 101 N MAIN ST
SHAWANO WI 54166-2355

138

112

107

THANK YOU FOR PURCHASING GROLIER INTERACTIVE PRODUCTS.

VOID

JUST A REMINDER...TO REGISTER YOUR GROLIER PRODUCTS, CALL
TOLL-FREE 1-800-285-4534

FOR DOCUMENT VERIFICATION HOLD THE BOX TO THE RIGHT OF ARROW BETWEEN THUMB AND FOREFINGER OR BREATHE ON IT. COLOR WILL DISAPPEAR AND REAPPEAR

108

116 THIS IS TESTING HEADER LINE 1
THIS IS TESTING HEADER LINE 2

000439817

120

GROLIER INTERACTIVE INC.

123

2050.1 1 300000021 0235734578 J

NOT GOOD FOR MORE THAN
*3.32*

124

127

PAY TO THE
ORDER OF
THREE & 32/100

VOID

BETTY GENKE $**3.32**

VOID IF NOT CASHED BEFORE
00/00/00

126

FIRST STATE BANK
LAKE LILLIAN MN 56253
75-1131/919

130

125

THE FACE OF THIS DOCUMENT HAS A COLORED BACKGROUND ON WHITE PAPER AND THE BACK HAS AN ARTIFICIAL WATERMARK. HOLD AT ANGLE TO VIEW

122 ⑈000439817⑈ ⑆091411315⑆ 100 482 000⑈ 105

POSTCARD CHECK

TECHNICAL FIELD

The present invention concerns a two sided postcard check having a postal bar code on one side and magnetic ink character recognition ("MICR") number on the other side, thereby facilitating the automatic processing of the check by the U.S. Postal Service and the banking system without having the MICR number be mutilated by the U.S. Postal Service.

BACKGROUND OF THE INVENTION

Manufacturers and retailers have promotions which promise a mail-in cash rebate by sending in proofs of purchase from one or a combination of their products. Firms which handle these promotions must mail checks payable to the purchaser for the amount of the mail-in cash rebate.

The firms handling these promotions want to (1) minimize costs of mailing a rebate check to a purchaser; (2) improve the deliverability of the mail; (3) increase the efficiency of the mailing; (4) insure that the check will be processed by the banks, including clearinghouses like the one at the Federal Reserve Bank; and (5) ensure that only the original check is cashed.

Because these rebate checks are mailed via the United States Postal Service ("Postal Service"), the firms must follow certain requirements imposed by the Postal Service to reduce the cost of mailing, improve the deliverability of the mail, and increase the efficiency of the mailing. The Postal Service uses a postal bar code which enables the Postal Service to automatically process mail, including postcard checks. Mail, having the postal bar code in the appropriate position, can be automatically processed. Therefore, firms which place the postal bar code in the correct location on the piece of mail will reduce the cost of mailing, increase the deliverability of the mail, and improve the efficiency of the mailing. Also, all other requirements concerning the information that must be contained in the postal bar code must be met, such as the postal bar code must contain the ZIP+4 form of the ZIP code.

For a check to be automatically processed by a bank and a clearinghouse like the Federal Reserve Bank, the check must contain a magnetic ink character recognition ("MICR") number. This MICR number includes data as to the routing number, the account number, and the dollar amount. These fields allow the check to be sorted using the Federal Reserve Bank's high speed sorting equipment and/or a bank's high speed sorting system. When a purchaser, who has received a check, deposits the check into his account at his bank, the bank sends that check to the Federal Reserve Bank's clearinghouse. The clearinghouse sorts the checks and sends the checks to the payor's bank. If a MICR number is either mutilated, nonexistent, and/or cannot be read by the automated system at the federal clearinghouse, the check will not be processed by the automated system. The check must either be manually read and entered into the system, or the check must be sent back to the payor's bank to have the MICR number rewritten so that the check can be processed. In either scenario, there is a delay in processing the check. The payee, the purchaser's bank, and the payor's bank want to avoid such a delay. Consequently, the MICR number must be positioned such that the check can be processed by the automated sorting system.

One form of a postcard check previously used by the assignee of the present application, Young America Corporation, contained all of the following information on one side: (1) the logo information; (2) the return address; (3) the postage indicia; (4) the bank information; (5) the check information; (6) the recipient of the check's name and address; (7) the postal bar code information; (8) the signature; and (9) the MICR number. The problem with this postcard check is that the Postal Service would paste a bar code sticker over the MICR number when processing the postcard check, thereby preventing the banks from processing the check by its automated system.

U.S. Pat. No. 1,264,795 to Hill discloses a combination postal card and check. This patent describes a card with a postal card form printed on one side and a check form printed on the other side. Also, on the postal card side, there is a space for endorsement by the payee. However, the postal card does not disclose a location for a postal bar code or a location for a MICR number.

U.S. Pat. No. 914,460 to Selden discloses a postal card with a check form on one side and a space for the stamp and address on the other side. The space for the endorsement of the check is on the same side as the check form. Also, the patent discloses a detachable stub attached to the postal card.

U.S. Pat. No. 5,085,470 to Peach discloses a postcard check comprising a tear away strip and a remainder. The postal bar code is printed on the tear away strip. The banking and checking account information is printed on the remainder.

There are two problems with the postcard check disclosed in Peach: (1) the payee is inconvenienced; and (2) the purchaser, while tearing the postal bar code strip, may tear a portion of the check containing the MICR number. First, having to tear away the postal bar code is an inconvenience to the payee. The payee must upon receipt of the postal card check of the Peach patent tear away the postal bar code before cashing the check at a bank. This additional step is an inconvenience to the payee.

Also, the payee may tear the check while tearing away the postal bar code strip. If the person tears the check such that the MICR number is torn or mutilated, then the check cannot be processed via the automated system of a clearinghouse like the clearinghouse at the Federal Reserve Bank.

Clearly, there is a need for a postcard check which has both a postal bar code and a MICR number placed such that both the postal and banking regulations are met, thereby facilitating automatic processing of both the postcard check at both the post office and the bank.

A problem faced by the firms which handle these promotions is to ensure security of the checks being mailed to customers. A common method for fraud is to copy a rebate check using a color copier so that the copied check is identical to the original check. Clearly, there is a need for a rebate check that prevents such fraud.

SUMMARY OF THE INVENTION

The present invention discloses a postcard check which can be automatically processed by the U.S. Postal Service and a check clearinghouse. The postcard check meets all the dimensional requirements set forth by the U.S. Postal Service to be classified as a postcard. Moreover, on one side of the postcard check, a postal bar code is placed and positioned such that the postal bar code permits the U.S. Postal Service to automatically process the postcard check through the U.S. mail system. Furthermore, on the other side of the postcard check, a MICR number is placed to allow the check to be processed automatically at a clearinghouse and the banks. Since the postal bar code and the MICR number are on opposite sides of the postcard check, the MICR number is not mutilated by the U.S. Postal Service when it automatically processes the check.

An object of the present invention is to provide a postcard check which can be automatically processed by the U.S. Postal Service, banks, and the check clearinghouses.

Another object of the present invention is to provide security for rebate checks.

BRIEF DESCRIPTION OF THE DRAWINGS

FIG. 1 shows a first side and a second side of a postcard check.

FIG. 7 shows the first side of a trifold mailer.

DETAILED DESCRIPTION OF THE PREFERRED EMBODIMENT

Figure 2:
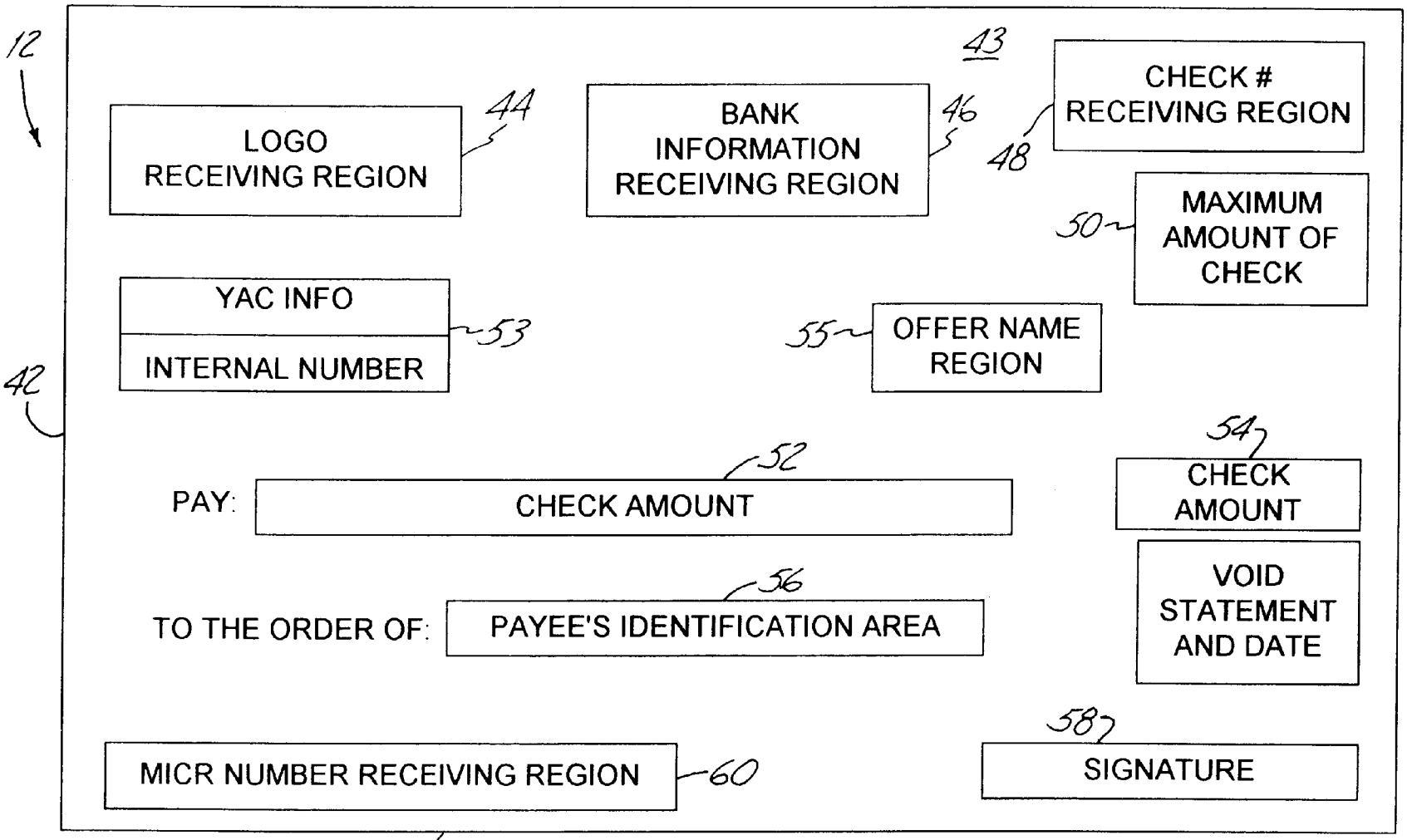
FIG. 2 shows a first side of a postcard check blank.

FIG. 1 shows a postcard check 10 having a first side 12 and a second side 14. The first side 12 of the postcard check 10 has the following: (1) a logo 16; (2) bank information 18; (3) a check number 20; (4) a written amount of the check 26 following the word "PAY"; (5) a numerical amount of the check 27; (6) payee's name 24 following the phrase "TO THE ORDER OF:"; (7) a signature 30; and (8) a magnetic ink character recognition ("MICR") number 22. Also, the first side 12 of the postcard check 10 has internal account numbers 21 for internal accounting purposes. Furthermore, the legends "NOT GOOD FOR MORE THAN" 23 and "VOID IF NOT CASHED BEFORE" 25 are also printed on the first side 12 of the postcard check 10 with space for an amount and a date respectively. Moreover, there is a field for the offer name 31.

Continuing to refer to FIG. 1, the second side 14 of the postcard check 10 has the following: (1) the return address 32; (2) postage 34; (3) a mailing address 36; (4) a postal bar code 38; and (5) an endorsement line 40.

The payor will mail the postcard check 10 to the payee, John Q. Public, 24. The U.S. Postal Service ("Postal Service") will automatically process the postcard check 10 by using the postal bar code 38. Moreover, during this processing, the MICR number 22 on the first side 12 of the postcard check 10 will not be mutilated. Consequently, when the payee deposits the check 10 at his bank, the check 10 will be added to the payee's account. The bank will send the postcard check 10 to a check clearinghouse such as the clearinghouse at the Federal Reserve Bank.

The clearinghouse at the Federal Reserve Bank has an automated system for sorting checks. Consequently, the MICR number 22 is used to sort the postcard check 10 so that it is routed to the payor's bank. The payor's bank can then transfer the amount 26 and 27 of the postcard check to the bank where the postcard check 10 was deposited. Thus, the postcard check 10 of the present invention enables the postcard check 10 to be processed efficiently through the mail and the banking system.

Figure 3:
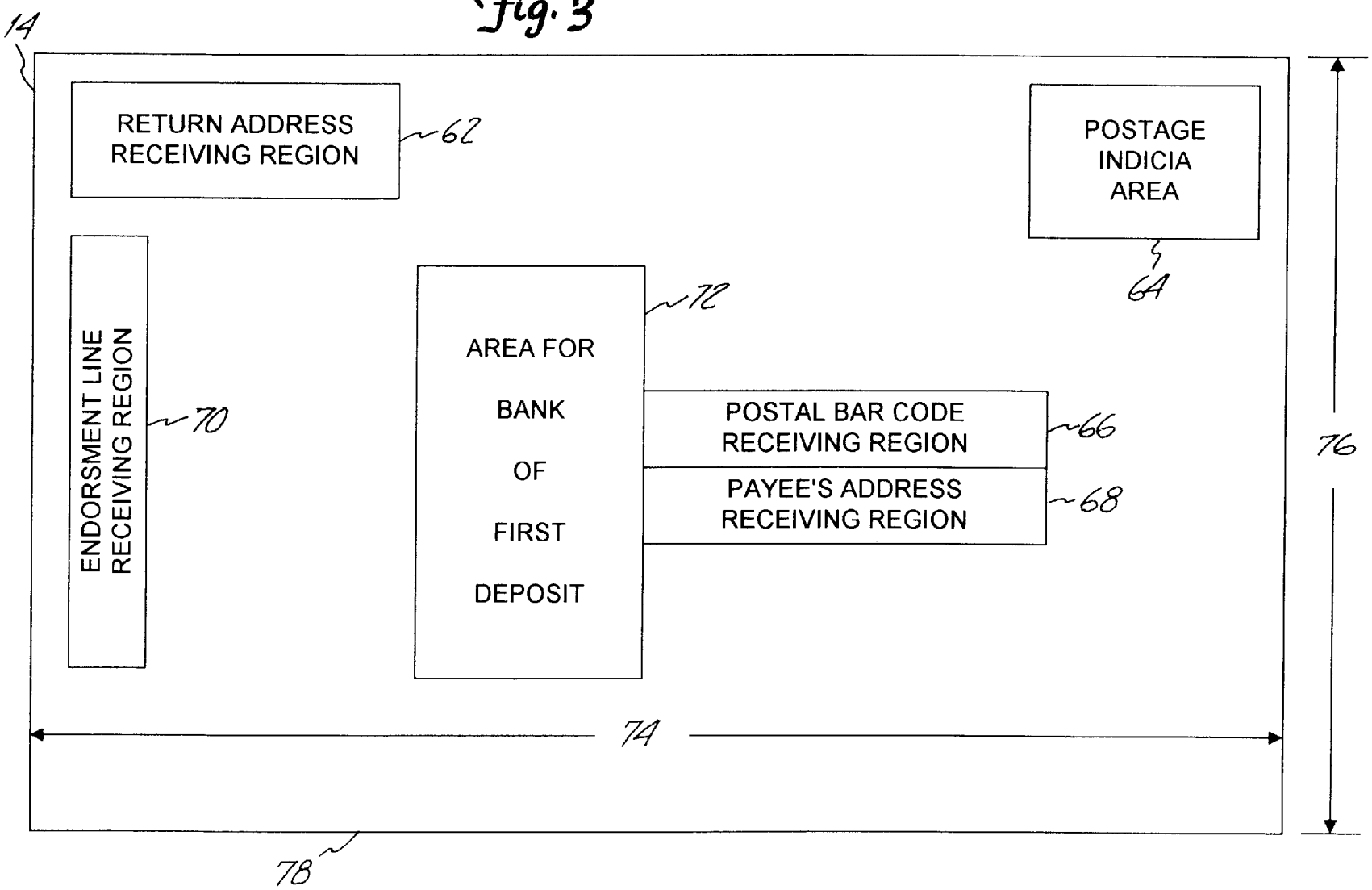
FIG. 3 shows a second side of a postcard check blank.

FIGS. 2 and 3 show a postcard check blank 42 for forming the postcard check 10 illustrated in FIG. 1. Referring to FIG. 2, the first side 43 of the postcard check blank 42 which forms the first side 12 of the postcard check 10 (see FIG. 1) has a logo receiving region 44, a bank information receiving region 46, a check number receiving region 48, a check limit receiving region 50, a written check amount receiving region 52, a numerical check amount receiving region 54, a payee name receiving region 56, a signature receiving block 58, and a MICR number receiving region 60. Also, there are regions for printing the internal number 53 and the offer name 55.

The logo receiving region 44 is located in the upper left corner of the postcard check blank 42. In the preferred embodiment, the logo 16 (see FIG. 1) of the sponsor will be displayed in the logo receiving region 44. For instance, FIG. 1 shows a M&M MARS® logo 16.

The bank information 18 (see FIG. 1) will be placed in the bank information receiving region 46. Bank information 18 placed in this region 46 includes, among other information, the payor bank's name, address, and telephone number. For instance, the bank information 18 (as shown in FIG. 1) which is placed in the bank information receiving region 46 includes the name of the bank—First State Bank -,the address of the bank—Lake Lillian, Minn. 56253-, and fractional numbering of the bank—75-1131/919.

The check number receiving region 48 will have the check number 20 (see FIG. 1) of the check being sent to a payee. In the postcard check 10 illustrated in FIG. 1, the check number "00012345" is printed in the check number receiving region 48. The check number 20 is used to control and track the number of checks being sent by the promotion clearinghouse to the various purchasers.

For security reasons, the maximum amount of money for which the check can be issued will be placed in the check amount limit region 50 under the legend "Not Good For More Than". By limiting the maximum amount of the check 10, the payee cannot manipulate the check amount 26, 27 so that a greater amount than the limit indicated in the maximum amount of the check region 50 will be cashed.

The amount of the check 26, 27 will be placed in the written check amount receiving region 52 and the numerical check amount receiving region 54. The check amount 26 (see FIG. 1) will be printed using words in the written check amount receiving region 52 and the check amount 27 (see FIG. 1) will be printed numerically 27 on the check 10 in the numerical check amount receiving region 54.

Also, the payee's name 24 (See FIG. 1) will be printed in the payee's identification area 56. As shown in FIG. 1, the payee 24 is John Q. Public, whose name was printed in the payee's identification area 56. Furthermore, the signature 30 (See FIG. 1) of the payor will be received in the signature receiving block 58.

Continuing to refer to FIGS. 1 and 2, a MICR number 22 (See FIG. 1) will be printed in the lower left corner of the postcard check blank 42. The MICR number 22 includes data as to the routing number, the account number, and the dollar amount. The MICR number 22 allows a check clearinghouse such as the clearinghouse at the Federal Reserve Bank and other banks to automatically process the check 10.

FIG. 3 shows the second side 14 of the postcard check blank 42. As shown in FIG. 3, the second side of the postcard check blank 42 has a return address receiving region 62, a postage indicia area 64, a postal bar code receiving region 66, a payee address receiving region 68, and an endorsement line receiving region 70. Also, an area for bank of first deposit 72 is included.

The return address 32 (see FIG. 1) will be printed in the return address receiving region 62, and the postage 34 (see FIG. 1) will be printed in the postage receiving region 64.

The mailing address 36 (see FIG. 1) will be placed in the mailing address receiving region 68. Usually, the postcard check 10 will be mailed to the payee 24 of the check 10.

A postal bar code 38 will be placed above the mailing address 36 in the postal bar code receiving region 66. The postal bar code 38 is positioned such that it meets federal postal regulations. The postal bar code 38 enables the Postal Service to automatically process the postcard check 10. This ability to automatically process the postcard check 10 will (1) reduce the cost of mailing the postcard check 10, and (2) will improve the efficiency of the mailing.

An endorsement line will be printed in the endorsement line receiving region 70. This endorsement line will be used by the payee 24 to endorse the check 10, thereby allowing the check 10 to be deposited in the payee's account.

The location of the endorsement line 40 and the area for bank of first deposit 72 on a postcard check is regulated by U.S. banking regulations. Consequently, the design of the check 10 of the present invention meets both U.S. postal and banking regulations relating to postcard checks.

Continuing to refer to FIG. 3, the dimensions of this postcard check blank 42 will now be described. Postcard check blank 42 has a length 74, a width 76, and a thickness 78. In the preferred embodiment, length 74, width 76, and thickness 78 will not exceed the dimensions specified by the Postal Service. Currently, the Postal Service dimensions for a postcard are as follows: (1) the length 74 should not be greater than 6 inches; (2) the width 76 should not be greater than 4¼ inches; and (3) the thickness 78 should not be greater than 0.0095 inches and the thickness 78 should be uniform. Currently, the thickness 78 of the postcard check 10 is 0.0077 inches.

With respect to the dimensions of the postcard, the following ranges are acceptable: the postcard check blank may have (1) a thickness between 0.0070 inches to 0.0095 inches; (2) a length between five (5) inches and six (6) inches; and (3) a width between three and one-half (3½) inches and four and one-quarter (4¼) inches.

When the desired information has been placed on both sides of the postcard check blank 42, the postcard check 10 is ready to be mailed. The postal bar code 38 will be used to automatically process the postcard check 10 through the postal system. Because of the positioning of the postal bar code 38 on the second side 14 of the postcard check 10, the MICR number 22 on the first side 12 of the postcard check 10 will not be mutilated.

The payee 24 upon receipt of the postcard check 10 will deposit the check 10 in his bank and in doing so will endorse the check 10 on the endorsement line 40 on the second side 14 of the postcard check 10. The postcard check 10 is sent to a clearinghouse like the clearinghouse at the Federal Reserve Bank to be sorted. The automated system at the clearinghouse uses the MICR number 22 on the first side 12 of the postcard check 10 to sort the check 10 and determine the amount to be paid to the payee's bank. This process enables a representative from the payor's bank to send the money to the payee's bank and settle all necessary transactions.

Figure 4:
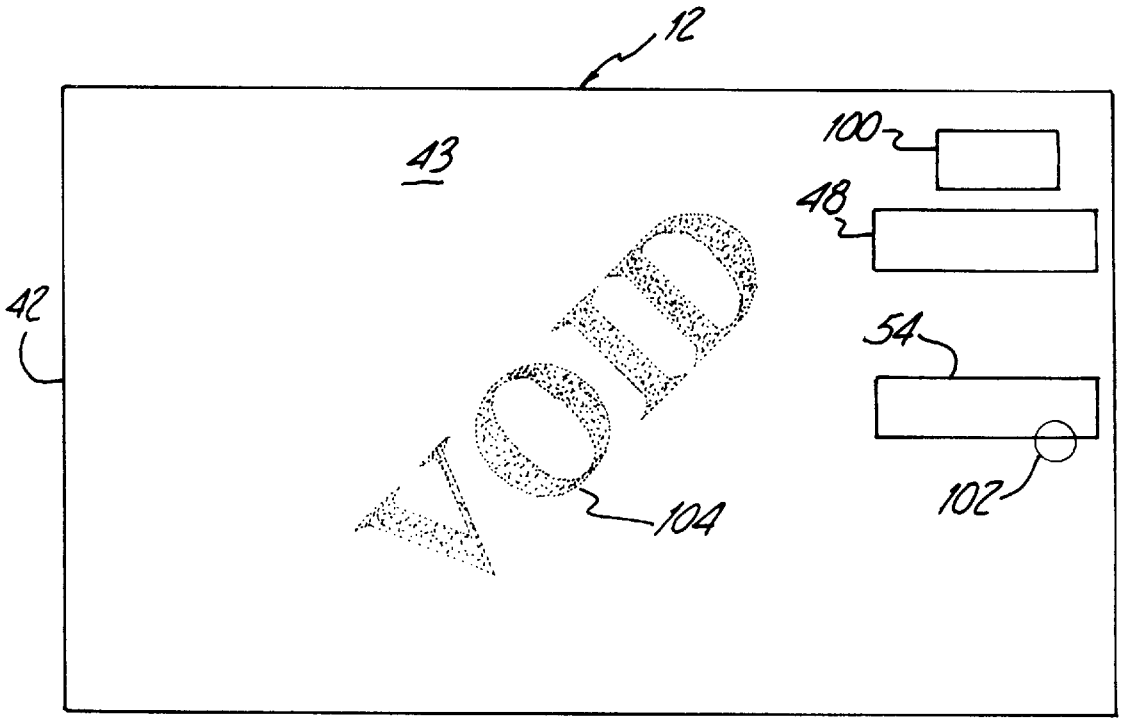
FIG. 4 shows a first side of a postcard check blank with a plurality of security features.
Figure 4D:
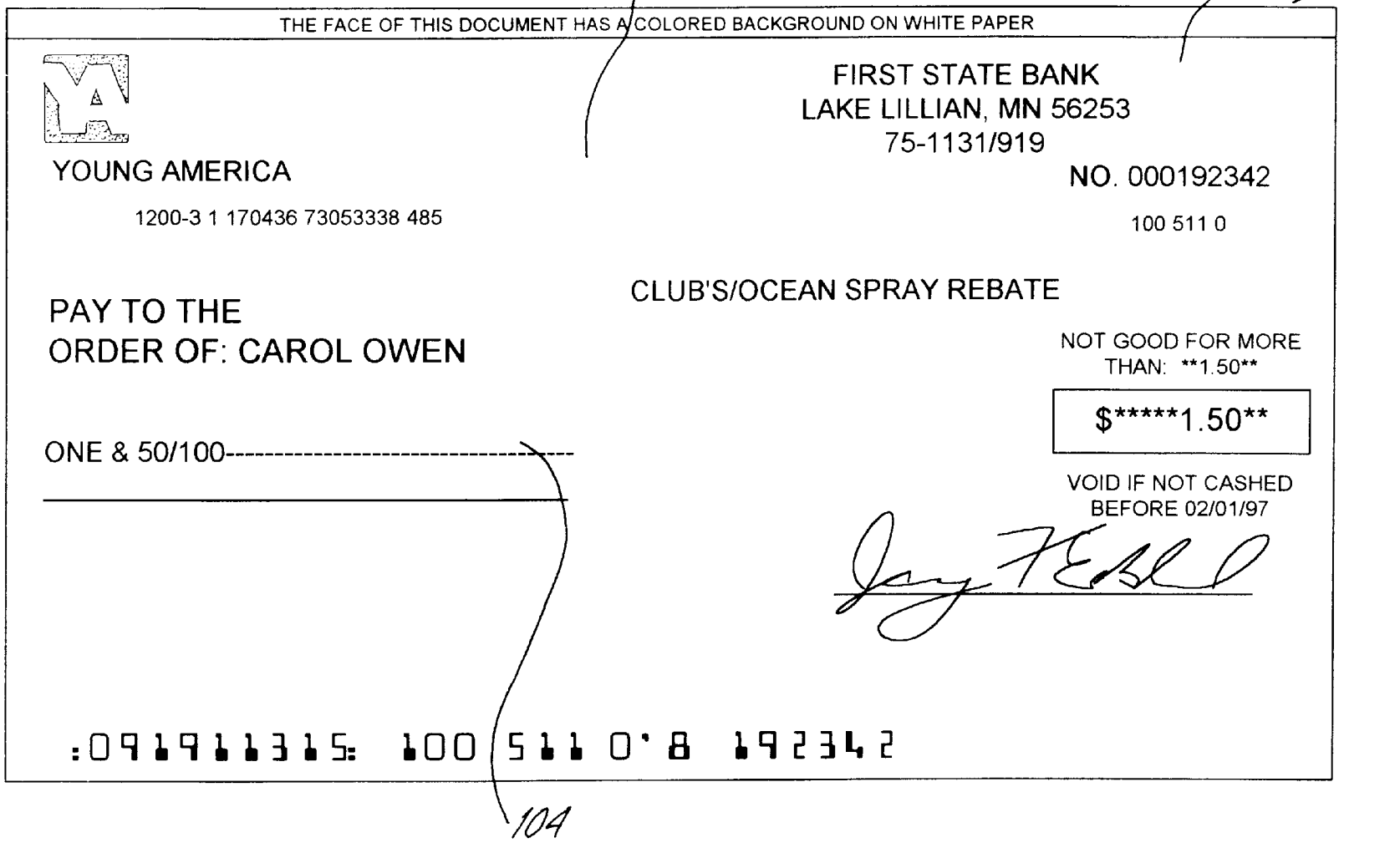
FIG. 4A shows a first side of a postcard check blank with an alternative application of the VOID panograph security feature.
Figure 5:
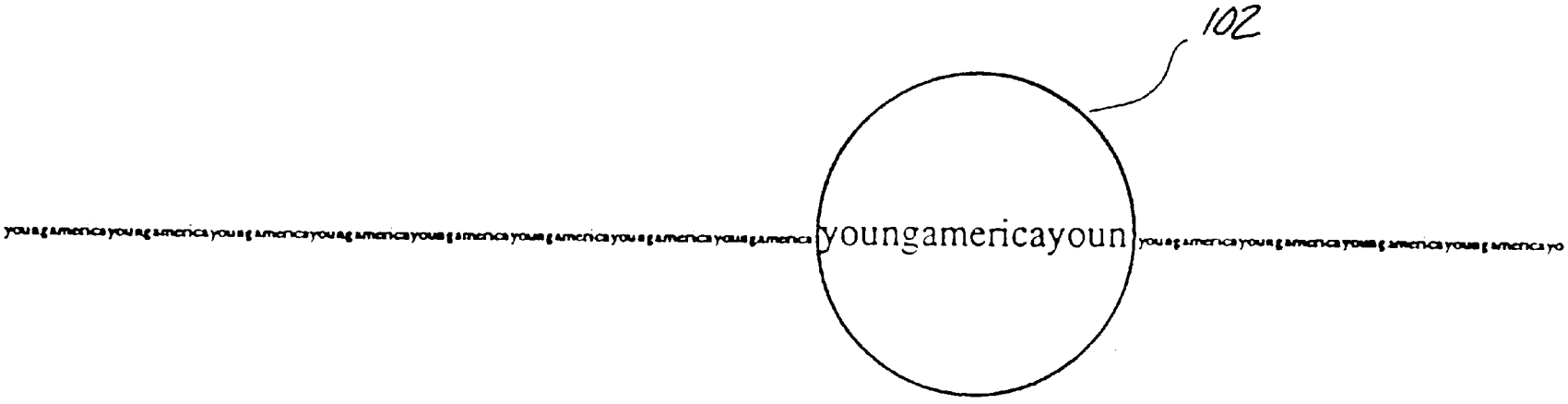
FIG. 5 shows a more detailed view of the area of circle 102 in FIG. 4.
Figure 6:
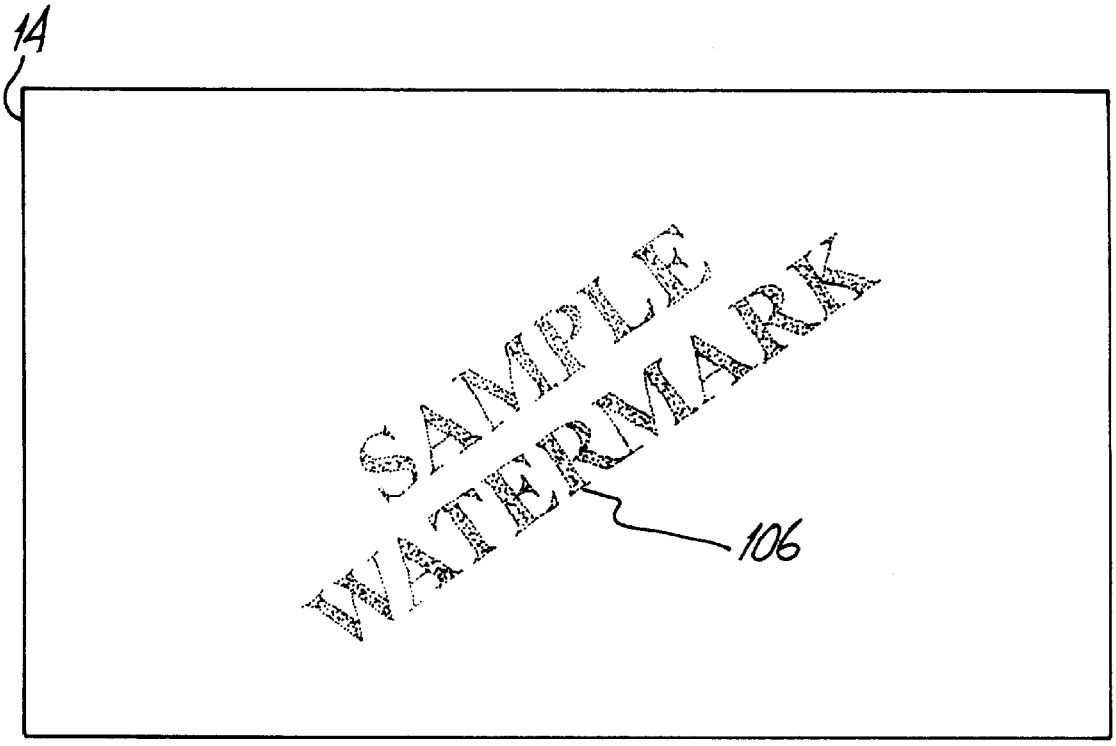
FIG. 6 shows the second side of a postcard check blank with a security feature.

With reference to FIGS. 4–6, the security features on the postcard check 10 will be described. FIG. 4 shows the security features on the first side 12 of the postcard check 10. As shown in FIG. 4, the postcard check comprises a void panograph 104, a microprint line 101, a portion of which is contained within circle 102, and a thermo ink box 100. The word "VOID" in void panograph shown in FIG. 4 is only visible when the mailer document containing the panograph is copied. Thus, this security device protects the rebate check from being copied and deposited several times. This void panograph 104 is applied to the first side 12 of the postcard check blank 42 using standard printing procedures. In the preferred embodiment, as shown in FIG. 4A, a plurality of VOID panographs are visible on a copied postcard check or mailer.

Furthermore, the first side 12 of the postcard check blank 42 contains a microprint line 101. FIG. 5 shows the detail of the microprint line 101 contained within the circle 102. When magnified, the microprint line 101 combining words or letters are readable. As an example, the microprint on the box 54 is "youngamerica". However, the microprint can be used on any line within the postcard check 10 and may use any combination of letters and numbers. This microprint is applied to the postcard check blank 42 using standard printing procedures.

The postcard check 10 also contains a thermo ink box 100. This box 100 contains ink which changes color upon detecting a change in temperature. Thus, a person by placing the box between their thumb and forefinger or breathing on the box 100, can determine whether the box 100 changes color. If the box 100 does change color, then the check is authentic. In the preferred embodiment, the box is pink. If the temperature changes, then the box turns to a white color for a few moments.

With reference to FIG. 6, the watermark security feature will be described. As shown in FIG. 6, the second side 144 of the postcard check blank 42 also contains a watermark which may be viewed at an angle. This mark will not be reproduced by a copier. Thus, by checking for this mark, a teller may verify that the form being handed to him/her is the original document.

It should be noted that each of these security features may be incorporated into a postcard check blank 42 singly or in combination. Also, although these features have been disclosed with respect to a postcard check, these features may be used to protect trifold mailers that include checks or coupons (see FIGS. 7 and 8).

FIG. 7 shows a trifold mailer 110 having a first side 112 and a second side 114 (not shown). The first side 112 of the mailer 110 has a top section 106, a middle section 107, and a bottom section 108. The top section 106 has the following: a logo 116; a return address 132, postage 134; a mailing address 136; and a postal bar code 138. The middle section 107 may contain messages from a manufacturer, other promotions, coupons, or checks. FIG. 7 shows a middle section having a message.

The bottom section 108 which may also contain messages from a manufacturer, other promotions, coupons, or checks. In FIG. 7, the bottom section contains a check 105 which has the following: (1) a logo 116; (2) bank information 118; (3) a check number 120; (4) a written amount of the check 126; (5) a numerical amount of the check 127; (6) payee's name 124 following the phrase "TO THE ORDER OF:"; (7) a signature 130; and (8) a magnetic ink character recognition ("MICR") number 122. Also, the legends "NOT GOOD FOR MORE THAN" 123 and "VOID IF NOT CASHED BEFORE" 125 are also printed on the check with space for an amount and a date respectively.

Figure 8:
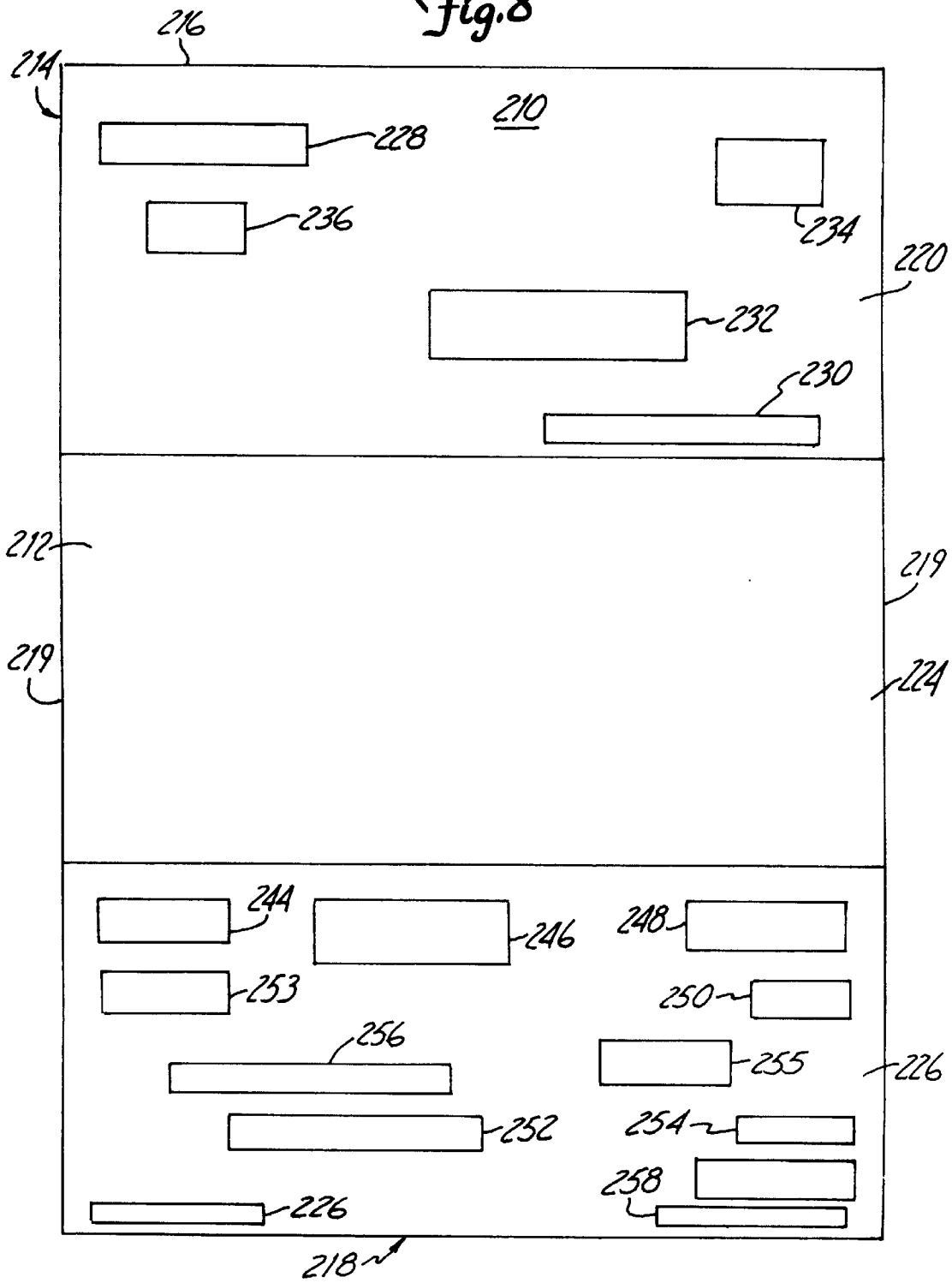
FIG. 8 shows the first side of a mailer blank.

As shown in FIG. 8, a trifold mailer comprises a mailer blank 210 having a first side 212 and a second side 214. The blank 210 has a top edge 216, a bottom edge 218, and a pair of side edges 219. In the preferred embodiment, the top edge 216 and the bottom edge 218 are parallel to each other, and the side edges 219 are parallel to each other. The mailer blank 210 comprises a top section 220, a middle section 224, and a bottom section 226.

The top section contains a return address receiving area 228, postal bar code receiving area 230, mailing address receiving area 232, a postage receiving area 234, and a logo receiving area 236. The middle and bottom sections 224, 226 may contain promotions, checks, coupons, or may be left blank. In the preferred embodiment, a check or coupon is in the bottom section.

FIG. 8 shows a mailer blank 210 in which the bottom section 226 forms the check 105 illustrated in FIG. 7. Referring to FIG. 8, the first side 212 of the bottom section 226 of the mailer blank 210 which forms the check (see FIG. 7) has a logo receiving region 244, a bank information receiving region 246, a check number receiving region 248, a check limit receiving region 250, a written check amount receiving region 252, a numerical check amount receiving region 254, a payee name receiving region 256, a signature receiving block 258, and a MICR number receiving region 260. Also, there are regions for printing the internal number 253 and the offer name 255. These regions contain the same type of information as on the previously-described postcard check 10.

Figure 9:
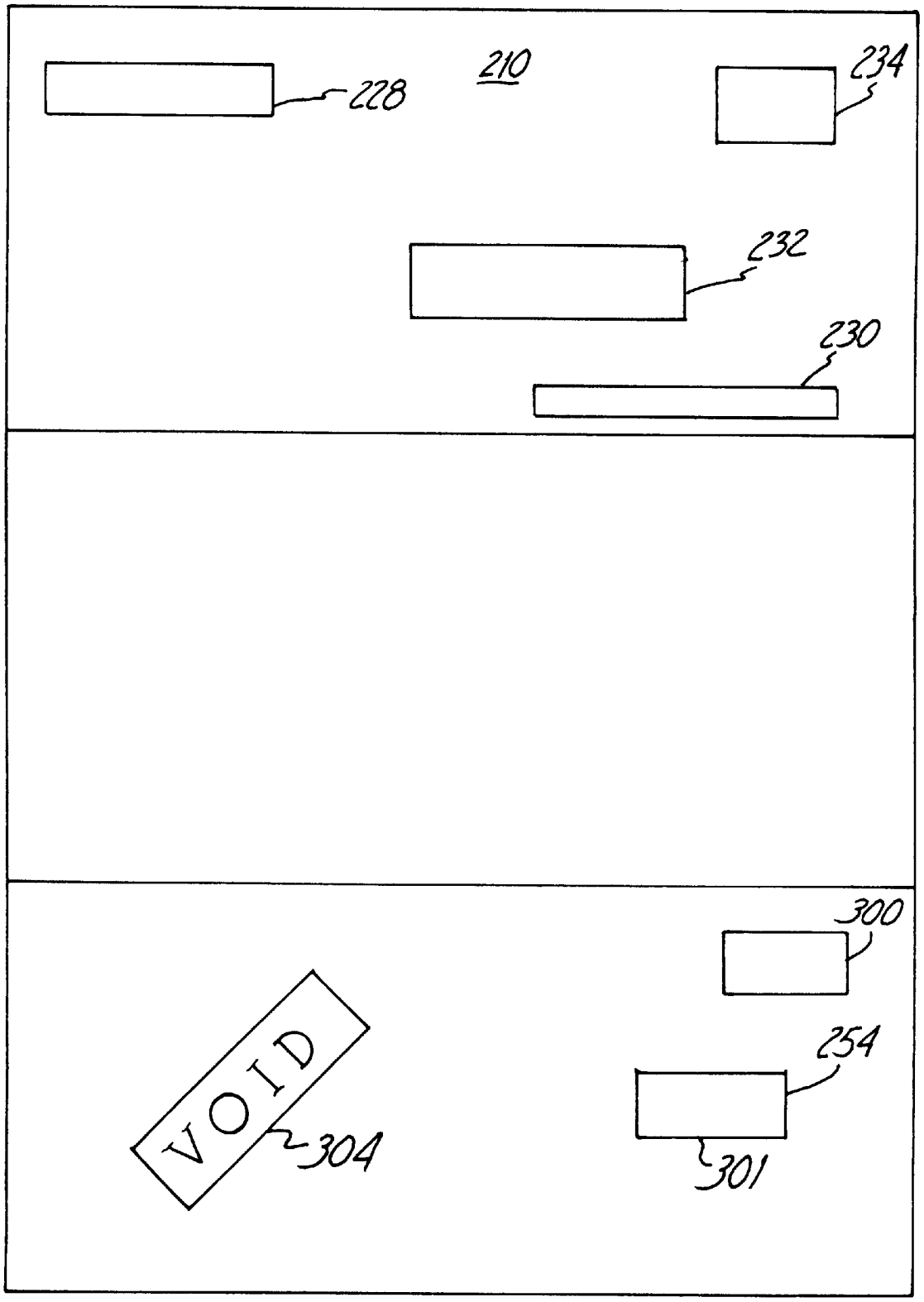
FIG. 9 shows the first side of the mailer blank having several security features.

As shown in FIG. 9, the security features (1) the thermo ink box 300; (2) the microprint 301; (3) the void panograph 304; and (4) the watermark 306 (not shown) may be used in this type of mailer 110. These features would be applied using standard printing procedures to the mailer blank 210. Also, these features may be used on any of the sections which form a document that requires security such as a check or a promotional offer.

While the preferred embodiment of the present invention has been described, it should be appreciated that various modifications may be made by those skilled in the art without departing from the spirit and scope of the present invention. Accordingly, reference should be made to the claims to determine the scope of the present invention.

What is claimed is:

1. A postcard check, comprising:

(a) a postcard check blank having a continuous top edge, a continuous bottom edge which is substantially parallel to said top edge, a pair of continuous side edges substantially parallel to each other;

(b) said postcard check blank having a substantially uniform thickness so that said postcard is without a line of weakness, a length, and a width;

(c) said postcard check blank having a first side and a second side;

(d) said second side of said postcard check blank having a postal bar code receiving area for receiving a postal bar code whereby when a postal bar code is placed in said postal bar code receiving area, said postal bar code is correctly positioned on said postcard check in accordance with the regulations of the United States Postal Service; and (e) said first side of said postcard check blank having a magnetic ink character recognition ("MICR") number receiving area for receiving a MICR number, whereby when a postal bar code is placed in the postal bar code receiving area and a MICR number is placed in the MICR number receiving area, the postcard check can be automatically processed.

2. The postcard check as recited in claim 1, wherein a ratio of said length, width, and thickness meet the requirements set forth by the U.S. Postal Service.

3. The postcard check as recited in claim 2, wherein said second side further comprises:

(a) a return address receiving area for placing a return address;

(b) a endorsement line area for placing an endorsement line for a payee to endorse the postcard check;

(c) a payee address receiving area for placing the payee's address;

(d) a postage receiving area for placing the postage required to mail the postcard; and (e) an area for the bank of first deposit for use by the bank of first deposit.

4. The postcard check as recited in claim 3, wherein said return address receiving area is located on the upper left corner of said second side of said postcard check.

5. The postcard check as recited in claim 4, wherein said endorsement line area is located under said return address area adjacent said left edge of said postcard check.

6. The postcard check as recited in claim 5, wherein the postal bar code receiving area is above the payee address receiving area, which is located in the lower center of said second side of said postcard check.

7. The postcard check as recited in claim 6, wherein said first side of said postcard check further comprises:

(a) a logo receiving area for receiving a logo of the company sponsoring the promotion for which the check is being mailed to the payee;

(b) bank information receiving region for placing the name and address of the bank;

(c) a written check amount receiving area for placing a written representation of the amount of the check;

(d) a numerical check amount receiving region for placing a numerical representation of the amount of the check; and (e) a signature receiving area for placing a signature for the check.

8. The postcard check as recited in claim 7, wherein said MICR number is located adjacent said lower edge of said first side.

9. The postcard check as recited in claim 1, further comprises a security feature.

10. The postcard check as recited in claim 9, wherein the security feature is a panograph that is visible when the check is photocopied.

11. The postcard check of claim 9, wherein the security feature is a thermo ink area.

12. The postcard check of claim 9, wherein the security feature is microprint.

13. The postcard check of claim 9, wherein the security feature is a watermark.

14. A postcard check, comprising:

(a) a generally rectangular postcard check blank having a continuous top edge, a continuous bottom edge which is substantially parallel to said top edge, a pair of continuous side edges substantially parallel to each other;

(b) said postcard check blank having a substantially uniform thickness not to exceed 0.0095 inches, so that said postcard is without a line of weakness, a length not to exceed six inches (6"), and a width not to exceed four and one-quarter inches (4¼");

(c) said postcard check blank having a first side and a second side;

(d) said first side of said postcard check blank comprises receiving regions for a payee name, a written representation of the amount of money payable by said check, a numerical representation of the amount of the money payable by said check, a signature block, bank information, and a check number;

(e) said first side of said postcard check blank having a magnetic ink character recognition ("MICR") number receiving area for placing a MICR number;

(f) said second side of said postcard check blank comprising a first address receiving region, a return address receiving region, an area for the bank of first deposit, and an endorsement line receiving region, wherein a first address is placed in the first address receiving region, a return address is placed in the return address receiving region, and an endorsement line for the payee to endorse the check is placed in the endorsement line receiving region; and (g) said second side of said postcard check blank having a postal bar code receiving area for placing a postal bar code, whereby said postcard check can be automatically processed by the United States Postal Service by using the postal bar code and said postcard check can be automatically processed by a Federal Reserve Bank using the MICR number.

15. The postcard check as recited in claim 14, further comprises a security feature.

16. The postcard check as recited in claim 15, wherein the security feature is a panograph that is visible when the check is photocopied.

17. The postcard check of claim 15, wherein the security feature is a thermo ink area.

18. The postcard check of claim 15, wherein the security feature is microprint.

19. The postcard check of claim 15, wherein the security feature is a watermark.

* * * * *